US010699820B2

(12) United States Patent
Nikolic et al.

(10) Patent No.: US 10,699,820 B2
(45) Date of Patent: Jun. 30, 2020

(54) THREE DIMENSIONAL RADIOISOTOPE BATTERY AND METHODS OF MAKING THE SAME

(71) Applicant: Lawrence Livermore National Security, LLC, Livermore, CA (US)

(72) Inventors: Rebecca J. Nikolic, Oakland, CA (US); Adam P. Conway, Livermore, CA (US); Roger A. Henderson, Livermore, CA (US); Victor P. Karpenko, Livermore, CA (US); Qinghui Shao, Fremont, CA (US); Dawn A. Shaughnessy, Livermore, CA (US); Mark A. Stoyer, Livermore, CA (US); Lars F. Voss, Livermore, CA (US)

(73) Assignee: Lawrence Livermore National Security, LLC, Livermore, CA (US)

( * ) Notice: Subject to any disclaimer, the term of this patent is extended or adjusted under 35 U.S.C. 154(b) by 540 days.

(21) Appl. No.: 14/214,244

(22) Filed: Mar. 14, 2014

(65) Prior Publication Data

US 2014/0264256 A1 Sep. 18, 2014

Related U.S. Application Data

(60) Provisional application No. 61/800,740, filed on Mar. 15, 2013.

(51) Int. Cl.
*G21H 1/00* (2006.01)
*G21H 1/06* (2006.01)

(52) U.S. Cl.
CPC ..... *G21H 1/06* (2013.01); *G21H 1/00* (2013.01)

(58) Field of Classification Search
CPC .. G21H 1/00; G21H 1/06; G21H 1/02; G21H 1/04; G21H 1/08; G21H 1/10; G21H 1/103; G21H 1/106; G21H 1/12
(Continued)

(56) References Cited

U.S. PATENT DOCUMENTS 3,706,893 A * 12/1972 Olsen ..... G21H 1/06 136/253
3,885,572 A 5/1975 Chen
(Continued)

FOREIGN PATENT DOCUMENTS

EP 0622811 2/1994
GB 1410761 10/1975
(Continued)

OTHER PUBLICATIONS

Nikolic et al. (6:1 aspect ratio silicon pillar based thermal neutron detector filled with 10B, Applied Physics Letters 93, 133502 (2008), pp. 1-3.*

(Continued)

*Primary Examiner* — Alfonso Perez Borroto
*Assistant Examiner* — Alexander Moraza
(74) *Attorney, Agent, or Firm* — Zilka-Kotab

(57) ABSTRACT

According to one embodiment, a product includes an array of three dimensional structures, where each of the three dimensional structure includes a semiconductor material; a cavity region between each of the three dimensional structures; and a first material in contact with at least one surface of each of the three dimensional structures, where the first material is configured to provide high energy particle and/or ray emissions.

15 Claims, 6 Drawing Sheets

(58) Field of Classification Search
USPC ..... 310/301–305; 250/390.01; 257/10, 429, 257/77; 438/20
See application file for complete search history.

(56) References Cited

U.S. PATENT DOCUMENTS

| | | | | |
|---|---|---|---|---|
| 3,934,162 | A | 1/1976 | Adler et al. | |
| 4,026,726 | A | 5/1977 | Carney | |
| 4,658,222 | A | 4/1987 | Wolf et al. | |
| 4,835,433 | A | 5/1989 | Brown | |
| 5,440,187 | A | 8/1995 | Little et al. | |
| 5,602,899 | A * | 2/1997 | Larson | G01N 23/2273 378/143 |
| 5,606,213 | A | 2/1997 | Kherani et al. | |
| 5,672,928 | A * | 9/1997 | Terhune | C23F 13/04 310/301 |
| 5,721,462 | A * | 2/1998 | Shanks | G21H 1/12 136/253 |
| 5,859,484 | A | 1/1999 | Mannik et al. | |
| 6,238,812 | B1 * | 5/2001 | Brown | G21H 1/00 310/302 |
| 6,479,919 | B1 * | 11/2002 | Aselage | G21H 1/02 310/301 |
| 7,482,533 | B2 | 1/2009 | Putnam | |
| 7,488,889 | B2 | 2/2009 | Putnam | |
| 7,491,881 | B2 | 2/2009 | Putnam | |
| 8,134,216 | B2 | 3/2012 | Spencer et al. | |
| 8,487,507 | B1 * | 7/2013 | Cabauy | G21H 1/06 310/301 |
| 8,653,715 | B1 * | 2/2014 | Baumbaugh | G21H 1/02 310/301 |
| 2004/0150290 | A1 * | 8/2004 | Gadeken | G21H 1/06 310/303 |
| 2006/0185153 | A1 | 8/2006 | Putnam | |
| 2006/0185719 | A1 | 8/2006 | Putnam | |
| 2006/0185720 | A1 | 8/2006 | Putnam | |
| 2006/0185721 | A1 | 8/2006 | Putnam | |
| 2006/0185722 | A1 | 8/2006 | Putnam | |
| 2006/0185723 | A1 | 8/2006 | Putnam | |
| 2006/0186378 | A1 | 8/2006 | Putnam | |
| 2006/0244410 | A1 | 11/2006 | Hacsi | |
| 2007/0080605 | A1 * | 4/2007 | Chandrashekhar | G21H 1/02 310/303 |
| 2007/0134840 | A1 * | 6/2007 | Gadeken | H01L 31/0284 438/56 |
| 2008/0199736 | A1 * | 8/2008 | Gadeken | G21H 1/06 429/5 |
| 2009/0263647 | A1 | 10/2009 | Gangopadhyay et al. | |
| 2010/0061503 | A1 | 3/2010 | Popa-Simil | |
| 2011/0031572 | A1 * | 2/2011 | Spencer | G21H 1/06 257/429 |
| 2011/0241144 | A1 * | 10/2011 | Spencer | G21H 1/02 257/429 |
| 2011/0291210 | A1 * | 12/2011 | Batchelder | G21H 1/06 257/429 |
| 2012/0043632 | A1 * | 2/2012 | Nikolic | G01T 3/08 257/429 |
| 2012/0081013 | A1 | 4/2012 | Frazier et al. | |
| 2012/0133244 | A1 | 5/2012 | Spencer et al. | |
| 2012/0161575 | A1 * | 6/2012 | Choi | G21H 1/06 310/303 |
| 2012/0219102 | A1 | 8/2012 | Shayer | |
| 2013/0187056 | A1 | 7/2013 | Nikolic et al. | |

FOREIGN PATENT DOCUMENTS

| | | |
|---|---|---|
| GB | 1414560 | 11/1975 |
| GB | 1419412 | 12/1975 |
| GB | 2363897 | 1/2002 |
| JP | 794772 | 4/1995 |
| JP | 2009128052 | 6/2009 |
| JP | 2012099275 | 5/2012 |
| KR | 2008067102 | 7/2008 |
| KR | 858490 | 9/2008 |
| KR | 861317 | 10/2008 |
| KR | 861385 | 10/2008 |
| KR | 2008087247 | 10/2008 |
| KR | 934937 | 1/2010 |
| WO | WO2007027589 | 3/2007 |
| WO | WO2011011504 | 1/2011 |

OTHER PUBLICATIONS

Https://www.sciencedirect.com/topics/pharmacology-toxicology-and-pharmaceutical-science/tritium (Year: 2019).*
From http://www.wikiwand.com/en/List_of_radioactive_isotopes_by_half-life (Year: 2019).*
Non-Final Office Action from U.S. Appl. No. 15/494,219, dated Sep. 10, 2018.
Final Office Action from U.S. Appl. No. 15/494,219, dated Jun. 13, 2019.
Advisory Action from U.S. Appl. No. 15/494,219, dated Sep. 25, 2019.
Non-Final Office Action from U.S. Appl. No. 15/494,219, dated Oct. 31, 2019.
Notice of Allowance from U.S. Appl. No. 15/494,219, dated Feb. 21, 2020.

* cited by examiner

THREE DIMENSIONAL RADIOISOTOPE BATTERY AND METHODS OF MAKING THE SAME

PRIORITY CLAM

The present invention is related to, and claims the benefit of priority from U.S. Provisional Patent Application No. 61/800,740, filed Mar. 15, 2013, which is herein incorporated by reference.

The United States Government has rights in this invention pursuant to Contract No. DE-AC52-07NA27344 between the United States Department of Energy and Lawrence Livermore National Security, LLC for the operation of Lawrence Livermore National Laboratory.

FIELD OF THE INVENTION

The present invention relates to batteries, and more particularly to three dimensional radioisotope semiconductor structures and methods of making the same.

BACKGROUND

Batteries typically comprise one or a connected set of similar units or cells acting as an electrical energy source. Most batteries operate by converting chemical energy directly into electrical energy. However, while chemical batteries are typically inexpensive to produce and may supply a reasonably high energy output, they may not be compatible with, for example, microelectronic devices due to size and durational requirements.

Other batteries generally referred to as nuclear or radioisotope batteries have been developed, which directly or indirectly convert radioactive energy released during the decay of a radioactive source into electrical energy. For instance, in some radioisotope batteries, a radioactive source emits nuclear radiation, e.g. alpha or beta particles, which produces electron-hole pairs within a planar semiconductor material. The movement of these charges over times results in an electronic current, which when connected to a load resistor operates as a source of power. However, such conventional planar radioisotope batteries often suffer efficiency, flexibility, scalability and low output power in the microwatt range.

SUMMARY

According to one embodiment, a product includes an array of three dimensional structures, where each of the three dimensional structure includes a semiconductor material; a cavity region between each of the three dimensional structures; and a first material in contact with at least one surface of each of the three dimensional structures, where the first material is configured to provide high energy particle and/or ray emissions.

According to another embodiment, a method includes forming an array of three dimensional structures, where each of the three dimensional structures includes a semiconductor material; and applying a first material to at least one surface of each of the three dimensional structures, where the material is configured to provide high energy particles and/or ray emissions.

Other aspects and embodiments of the present invention will become apparent from the following detailed description, which, when taken in conjunction with the drawings, illustrate by way of example the principles of the invention.

BRIEF DESCRIPTION OF THE DRAWINGS

For a fuller understanding of the nature and advantages of the present invention, reference should be made to the following detailed description read in conjunction with the accompanying drawings.

DETAILED DESCRIPTION

The following description is made for the purpose of illustrating the general principles of the present invention and is not meant to limit the inventive concepts claimed herein. Further, particular features described herein can be used in combination with other described features in each of the various possible combinations and permutations.

Unless otherwise specifically defined herein, all terms are to be given their broadest possible interpretation including meanings implied from the specification as well as meanings understood by those skilled in the art and/or as defined in dictionaries, treatises, etc.

It must also be noted that, as used in the specification and the appended claims, the singular forms "a," "an" and "the" include plural referents unless otherwise specified.

As also used herein, the term "about" denotes an interval of accuracy that ensures the technical effect of the feature in question. In various approaches, the term "about" when combined with a value, refers to plus and minus 10% of the reference value. For example, a thickness of about 10 nm refers to a thickness of 10 nm±1 nm, a temperature of about 50° C. refers to a temperature of 50° C.±5° C., etc.

The following description discloses several embodiments of high efficiency three dimensional semiconductor structures, preferably having radioactive materials deposited thereon, and/or related systems and methods.

In one general embodiment, a product includes an array of three dimensional structures, where each of the three dimensional structure includes a semiconductor material; a cavity region between each of the three dimensional structures; and a first material in contact with at least one surface of each of the three dimensional structures, where the first material is configured to provide high energy particle and/or ray emissions.

In another general embodiment, a method includes forming an array of three dimensional structures, where each of the three dimensional structures includes a semiconductor material; and applying a first material to at least one surface of each of the three dimensional structures, where the material is configured to provide high energy particles and/or ray emissions.

Figure 1:
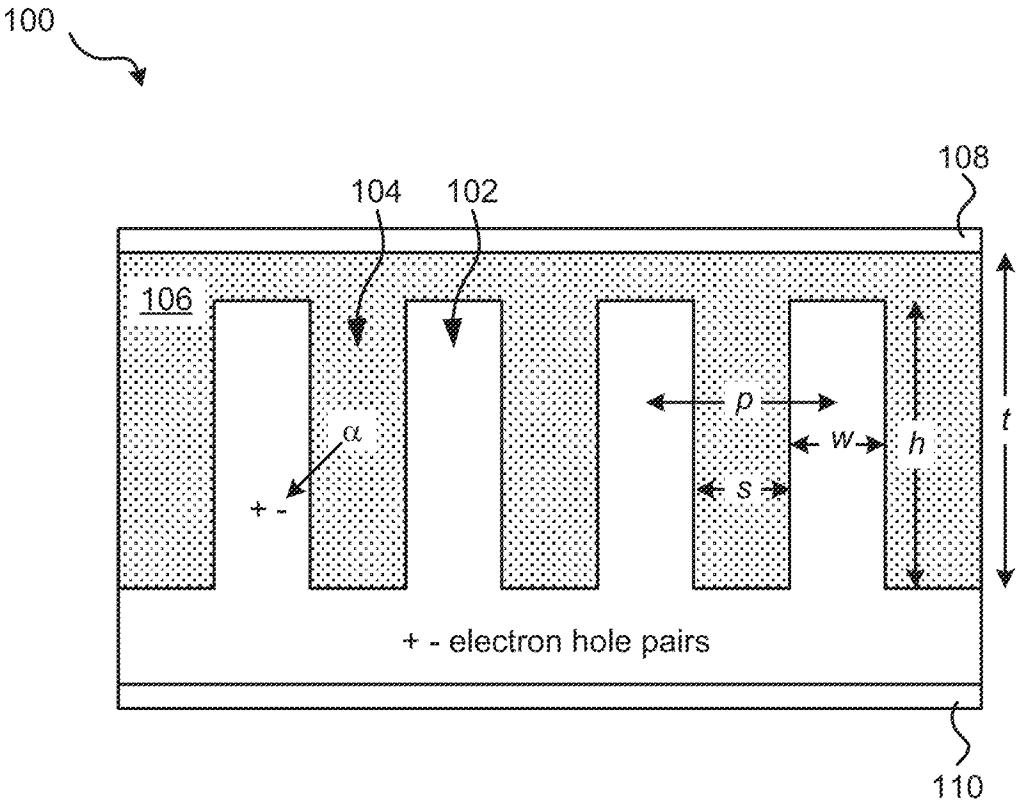
FIG. 1 shows a schematic of a structure including an array of three dimensional structures with cavity regions therebetween, according to one embodiment.
Figure 2A:
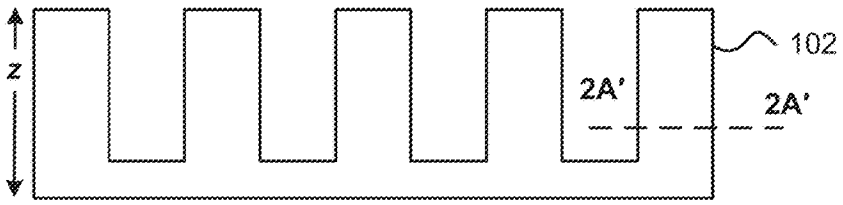
FIGS. 2A-2G show schematics of various cross sectional shapes of the three dimensional structures from FIG. 1, according to some embodiments.
Figure 2C:
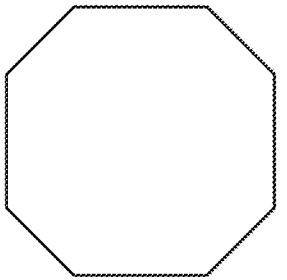
Figure 2B:
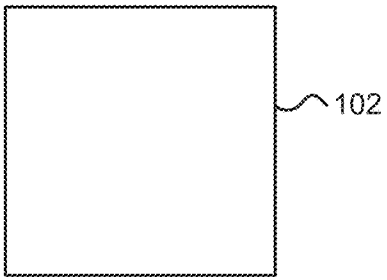
Figure 2D:
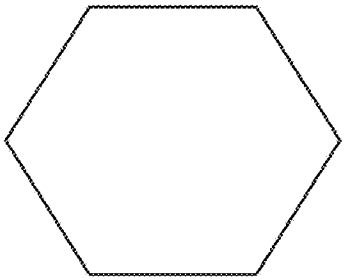
Figure 2F:
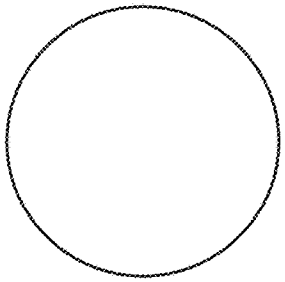
Figure 2E:
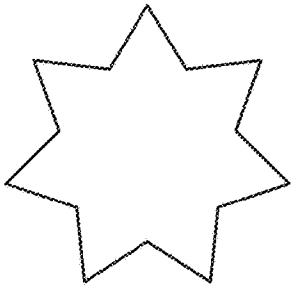
Figure 2G:
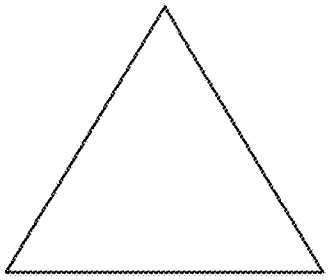

Referring now to FIG. 1, a product 100 including an array of three dimensional structures 102 is shown according to one embodiment. As an option, the present product 100 may be implemented in conjunction with features from any other embodiment listed herein, such as those described with reference to the other FIGS. Of course, however, the product 100 and others presented herein may be used in various applications and/or in permutations, which may or may not be specifically described in the illustrative embodiments listed herein. In various approaches, the product 100 may be particularly useful as a radioisotope battery.

As shown in FIG. 1, the product 100 includes an array of three dimensional structures 102 with cavity regions 104 between each of the three dimensional structures 102. In some approaches, the three dimensional structures 102 may comprise a rounded, rectangular, elliptical, square, triangular, irregular, etc. cross sectional shape, where the cross section is taken perpendicular to a longitudinal axis of the three dimensional structures. For example, as shown in FIGS. 2A-2G, illustrative cross sectional shapes of the three dimensional structures 102, as viewed in cross section along a plane (denoted by line 2A') oriented perpendicular to its longitudinal axis (z), may include, but are not limited to, a square (FIG. 2B), octagon (FIG. C), hexagon (FIG. 2D), star (FIG. 2E), triangle (FIG. 2E), circle (FIG. 2G), etc., or other such suitable shapes as would be recognized by one having skill in the art upon reading the present disclosure.

With continued reference to FIG. 1, the three dimensional structures 102 may have a tapered profile in other approaches. For instance, each three dimensional structure 102 may have an upper portion and a lower portion (the lower portion of each of the three dimensional structures 102 positioned towards the bottom surface thereof, e.g. towards the electrical contact 110), where the upper portion has a smaller average width relative to an average width of the lower portion (the widths being oriented perpendicular to the longitudinal axis of the three dimensional structures 102).

In yet other approaches, the three dimensional structures 102 may include pillar structures with cavity regions 104 therebetween. U.S. patent application Ser. No. 13/747,298, filed Jan. 15, 2013, describes three dimensional pillar structures and methods of making the same, which may be adapted for use in various embodiments disclosed herein, and is incorporated herein by reference.

In more approaches, the three dimensional structures 102 may include ridge structures with cavity regions 104 therebetween. Of course, other three dimensional structures recognized by one skilled in the art upon reading the present disclosure may be used.

In yet more approaches, the three dimensional structures 102 may be arranged in the array such that a separation between each of the three dimensional structures 102 is about uniform. For instance, in one particular approach, the array of three dimensional structures 102 may be arranged in a hexagonally close packed (HCP) array.

In additional approaches, each of the three dimensional structures 102 may have a width, w, of about 0.5 to about 500 μm, and/or a height, h, of about 2 to about 500 μm, e.g., about 4 μm, about 10 μm, about 12 μm, about 20 μm, about 50 μm, or about 500 μm, up to approaching the thickness of the host substrate. Moreover, in numerous approaches, the separation, s, between adjacent three dimensional structures 102 may be in a range from about 1 μm to about 10 μm, and/or the center-to-center spacing (i.e. the pitch, p) between the three dimensional structures 102 may be in a range from about 2 to about 10 μm. Further, in more approaches, each of the three dimensional structures 102 may have an aspect ratio of less than or equal to about 100:1, where the aspect ratio corresponds to the ratio of the height of a three dimensional structure relative to its width and/or pitch. It is important to note, however, that said dimensions (diameter, pitch, height, aspect ratio, etc.) serve only as an example and are not limiting in any way, such that various embodiments may have larger or smaller dimensions.

According to yet more approaches, a width, height aspect ratio and/or semiconductor material(s) of the three dimensional structures 102 may be selected/determined by an alpha or beta particle range (e.g. the range at which the alpha and beta particles are stopped in the structures). In specific embodiments, the width of the three dimensional structures 102 may be about twice this alpha and/or beta particle range. For example, the width of the three dimensional structures 102 may be about 10 to about 100 microns, in various embodiments. According to further approaches, the dimensions (e.g. the width, aspect ratio, height, etc.) and/or composition of the three dimensional structures 102 may be selected to spread out radiation damage over a wider area to mitigate the damage.

According to still more approaches, a height of the three dimensional structures 102 may be selected to maximize the output power of the product 100. The output power of the product 100 may be about equal to or greater than about 1 W, about 10 W and about 100 W, in various embodiments. Moreover, in approaches where the three dimensional structures 102 include a semiconductor material, as discussed below, the large volume of the three dimensional semiconductor structures may dramatically increase power density instead of limiting said power density to the surface as in planar semiconductor designs that only provide microwatt power.

In a preferred approach, each of the three dimensional structures 102 may include one or more semiconductor materials. According to some embodiments, the one or more semiconductor materials may include, but are not limited to, silicon, gallium arsenide, SiC, GaN, and indium phosphide. SiC and/or GaN may be of particular interest for use in the three dimensional structures 102 due to their high atomic displacement energies (>20 eV) compared to Si (>13 eV), as well as their wide band gap, making them suitable for operation at high temperatures.

In other embodiments the one or more semiconductor materials may include crystalline materials (e.g. single crystal silicon); amorphous materials (e.g. amorphous silicon, a-Si). In embodiments where the semiconductor material is a-Si, which is radiation hard because of the lack of crystallinity, disruptions in the crystalline lattice due to atomic displacements may not be as problematic. In yet other embodiments, the one or more semiconductor of materials may be selected to include crystalline materials or amorphous materials based on a desired radiation damage resistance.

In more embodiments, the semiconductor material(s) may include one or more icosahedral borides, such as icosahedral boron arsenide ($B_{12}As_2$) and icosahedral boron phosphide ($B_{12}P_2$), which may be particularly advantageous due to their resistance to radiation damage.

In yet more embodiments, the semiconductor material(s) may be a self-healing material (e.g. a material configured to mitigate and/or reverse radiation damage).

In further approaches, the semiconductor material(s) of the three dimensional structures 102 may have a p-type conductivity region and an n-type conductivity region with a p-n junction therebetween. Other approaches include using heterojunctions to create band offsets for diode formation. In particular embodiments, the n-type and p-type regions may be electrically connected to a load circuit. For example, in one embodiment, the array of three dimensional structures 102 comprising the one or more semiconductor materials may be positioned above and/or formed on a substrate (not shown in FIG. 1), where such substrate may include a semiconductor material, silicon, quartz, etc. or other suitable substrate material as would be understood by one skilled in the art upon reading the present disclosure. In such embodiments, an upper portion, and/or one or more sides of each of the three dimensional structures may include a $p^+$ layer, where the upper portion of each of three dimensional structures is positioned away from the substrate and the one or more sides of the structures are positioned parallel to the substrate normal. Moreover, the substrate may serve as an $n^+$ layer, such that the array of three dimensional structures on the substrate forms a p-i-n diode array. A high doping layer may also be applied to cover the top layer of the three dimensional structures, and/or to cover all surfaces of the three dimensional structures, etc., in various approaches.

As also shown in FIG. 1, a first material 106 may coat, or be in contact with, at least one surface of the three dimensional structures 102, which may include a semiconductor material. In various approaches, the first material 106 may form a layer directly on the three dimensional structures 102. In preferred approaches, the first material 106 may be configured to provide high energy particle (e.g. alpha and/or beta particles) and/or ray (e.g. gamma ray) emissions. For example, in one approach, the first material 106 may include a tritiated metal.

In another approach, the first material 106 may comprise a radioisotope. This radioisotope may be selected based on a decay type and/or a decay energy, in some embodiments. For example, in one particular embodiment, the radioisotope may be an alpha particle emitter including, but not limited to, $^{148}$Gd, $^{241}$Am, and $^{238}$Pu. In another embodiment, the radioisotope, may be a beta particle emitter including, but not limited to, $^{63}$Ni and $^{106}$Ru. In yet another embodiment, the selected radioisotope may be an alpha particle emitter because alpha particle emitters such as $^{148}$Gd, $^{241}$Am, and $^{238}$Pu may have a higher output power than beta particle emitters such as $^{63}$Ni and $^{106}$Ru. A higher activity may lead to a short expected lifetime of the device due to damage within the three dimensional structures comprising a semiconductor material.

In a further embodiment, the radioisotope may be $^{233}$U. In an additional embodiment, the radioisotope may be $^{232}$U, which emits a 5 MeV alpha particle with a weak emission of a low energy gamma-ray (57 keV). Use of $^{232}$U as the radioisotope may be advantageous due to its decay properties and half-life of 70 years. The half-life of $^{232}$U may be suitably long enough for a battery yet short enough to obtain the specific activity required for current generation.

In various embodiments, the radioisotope included in the first material 106 may undergo spontaneous decays in the form of both short-range alpha and beta particles along with much longer range gamma-rays, in such embodiments, self-capture may occur within the product 100 itself and shielding, using various metals, may completely contain the radiation for safe handling.

The radioisotope included in the first material 106 may lose energy by both spontaneous decays and also by heat dissipation. The heat may be mitigated by heat sinks such as liquid coolants, in more embodiments. The heat of the radioisotope may also be used as an in-situ anneal in order to repair damage as it is created, extending the life of the product 100 in still more embodiments.

Figure 6:
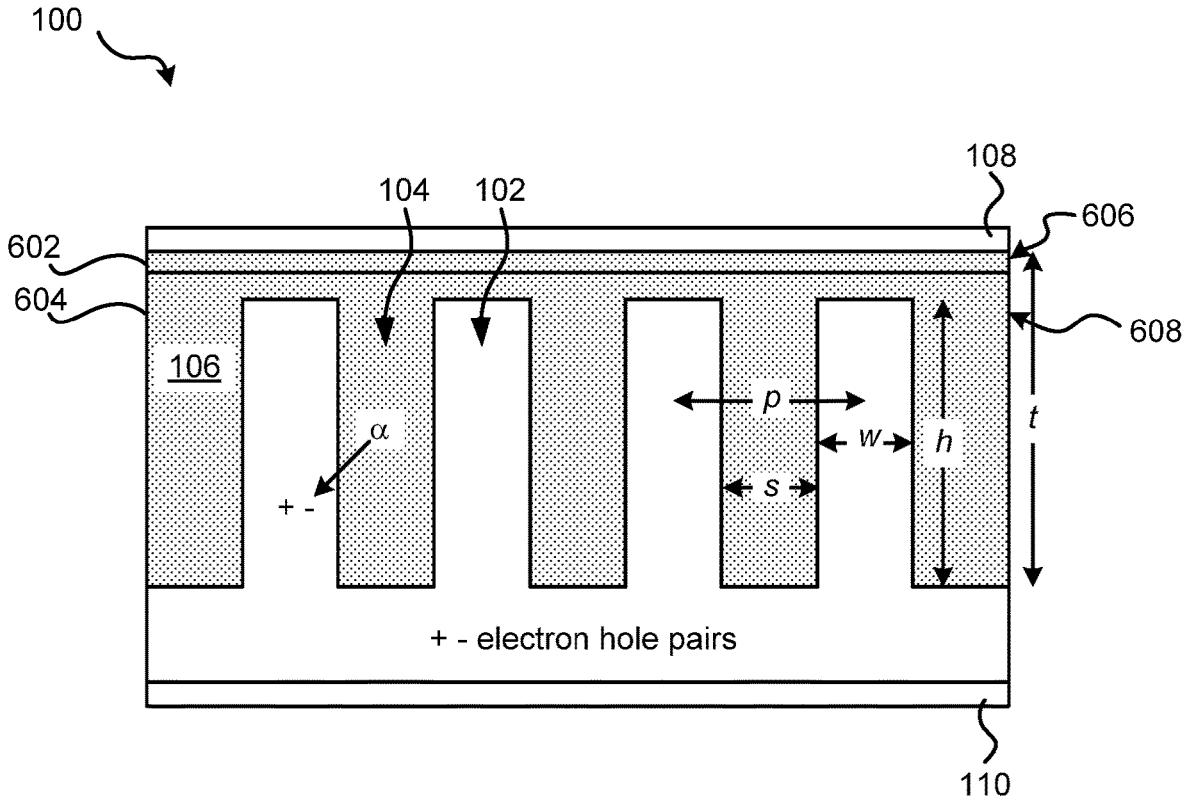
FIG. 6 shows a schematic of a structure including an array of three dimensional structures with cavity regions therebetween, according to one embodiment.

In some approaches, the first material 106 may include more than one radioisotope. For example, in one embodiment, the first material 106 may include two or more layers 602, 604 as shown in FIG. 6, where each layer includes at least one radioisotope 606 that is different from a radioisotope 608 in the other layers. In another embodiment, the first material may include a single layer having two or more different isotopes. Such embodiments involving two or more different radioisotopes in the first material 106 may create various output power versus time characteristics, e.g. flat (or increasing or decreasing) output power over time as compared to using a single radioisotope.

In various approaches, the first material 106 may have a thickness selected to facilitate electron-hole charge carrier generation. In particular approaches, the first material 106 may have a thickness, t, of between about 50 to about 500 microns.

Figure 3B:
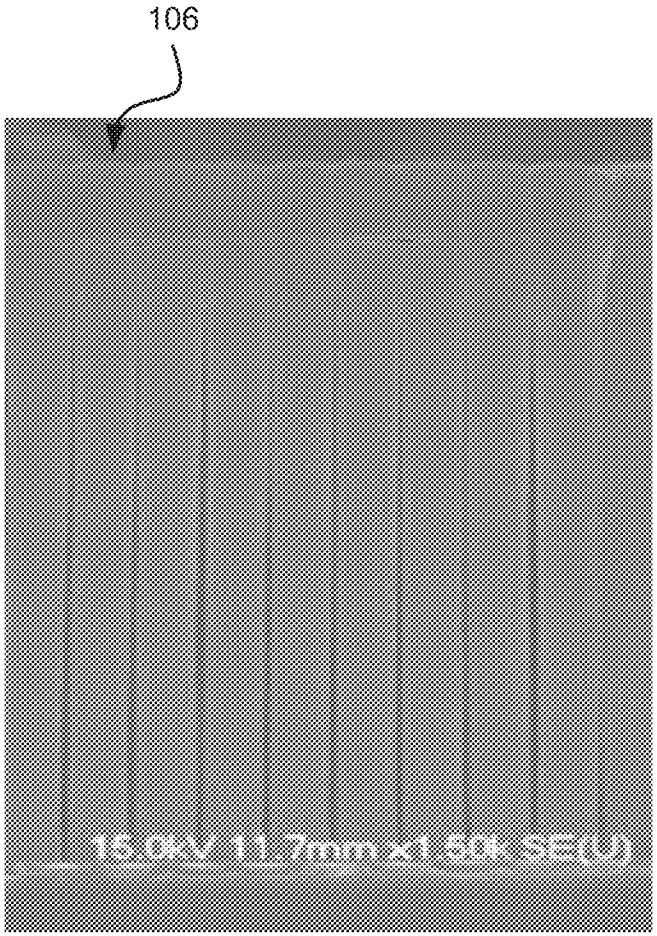
FIGS. 3A and 3B show scanning electron microscopy images of an array of three dimensional structures without a first material deposited thereon and with a first material deposited thereon, respectively.
Figure 3A:
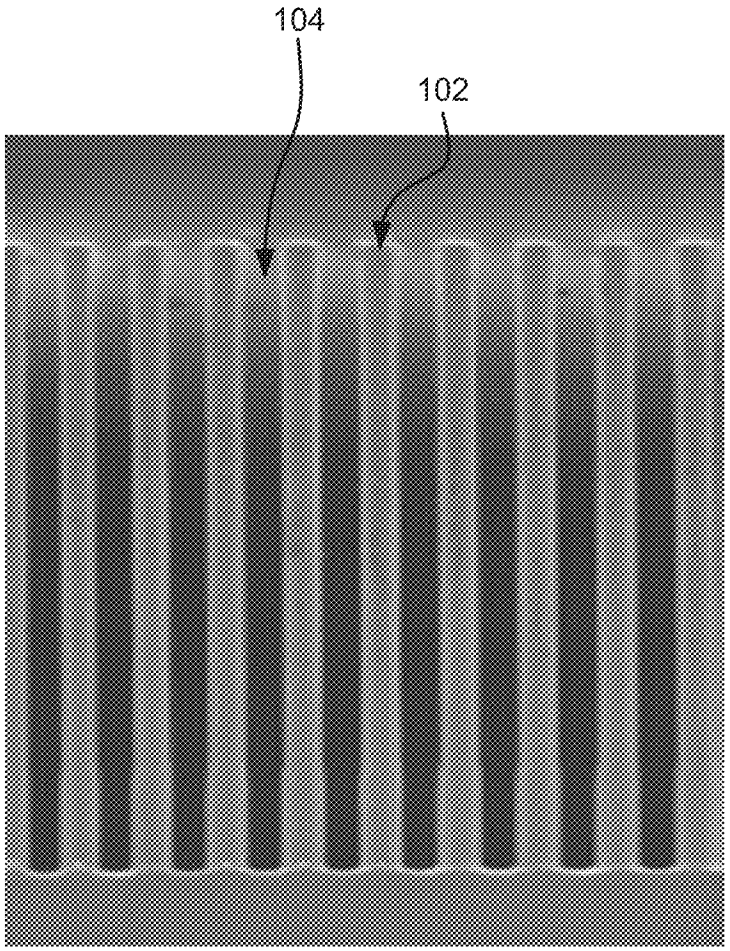

In other embodiments, the first material 106 may cover the tops of the three dimensional structures 102 and/or completely the cavity regions 104. In yet other embodiments, the cavity regions 104 may be under-filled, such that the first material 106 may only partially fill the cavity regions 104. For example, in approaches where the cavity regions 104 may be under-filled, the first material 106 may only fill a percentage, ranging from about 25% to about 99.5%, of the volume of the cavity regions 104. FIGS. 3A-3B provides a scanning electron microscopy (SEM) image of an array of three dimensional pillar structures without a coating of the first material (FIG. 3A) and with a coating of the first material (FIG. 3B).

With continued reference to FIG. 1, the three-dimensional structures 102 may include one or more electrically conductive and/or semiconductor materials in various approaches. However, in other approaches where the three dimensional structures 102 may not include a semiconductor material or are otherwise unable to generate electron hole pairs in the described configurations, a supplemental layer of semiconductor material may nevertheless overlie the three dimensional structures 102. This supplemental layer of semiconductor material may be considered part of the three-dimensional structures 102, according to numerous embodiments. Moreover, a layer of the first material 106, which preferably includes a radioisotope, may overlie the three-dimensional structures 102 and/or the supplemental layer of semiconductor material deposited thereon.

In more approaches, one or more additional materials (e.g. a second, third, fourth, fifth, sixth, etc. material) may coat and/or be deposited above the three dimensional structures 102 and/or the first material 106. In particular embodiments, the one or more additional materials may form a layer that is deposited directly on the first material 106. In other embodiments, the one or more additional materials may form a plurality of layers that are deposited above the first material 106. In further embodiments, these one or more additional materials may be stacked in such a manner as to build up to a large "sugar cube" size.

In more embodiments, at least one of the one or more additional materials may have a composition and/or one or more components therein that is/are the same or different than the first material 106. In yet more embodiments, at least one of the one or more additional material may comprise radioisotope(s) that may be different or the same from radioisotope(s) included in the first material 106. In some approaches, each of the one or more additional materials may comprise radioisotope(s), some or all of which may be the same or different from one another. For instance, in particular approaches, the radioisotopes included within the first material and/or each of the one or more additional materials may be independently selected from a group consisting of $^{148}$Gd, $^{238}$Pu, $^{244}$Cm, $^{243}$Am, $^{241}$Am, $^{63}$Ni, $^{106}$Ru, and $^{232}$U.

As also shown in FIG. 1, outer electrical contacts 108 and 110 may be positioned below the lower/bottom surface of the three dimensional structures 102 and above the first material 106 (and/or any additional of the aforementioned additional materials), respectively. The electrical contacts 108, 110 may be in electrical communication with the three-dimensional structures 102 and/or the supplemental semiconductor material using conductive paths, direct contact, etc. Moreover, busing may be used to facilitate the transmission of electrical signals. Such busing may include an underlayer, an overlayer, wires, conductive grids, etc. in electrical communication with the appropriate structures/layers.

In some approaches, the product 100 may include two or more separate arrays of three dimensional structures 102. In various embodiments, these two or more separate arrays may be stacked; electrically connected in series and/or parallel; etc. Any type of busing may be used to create the electrical interconnections.

In yet more approaches, the product 100 may be modular in order to locate required power and/or heat in multiple locations within a system to optimize performance. In such approaches, the performance may not rely on the entire radioactivity to be located in one place.

Figure 4:
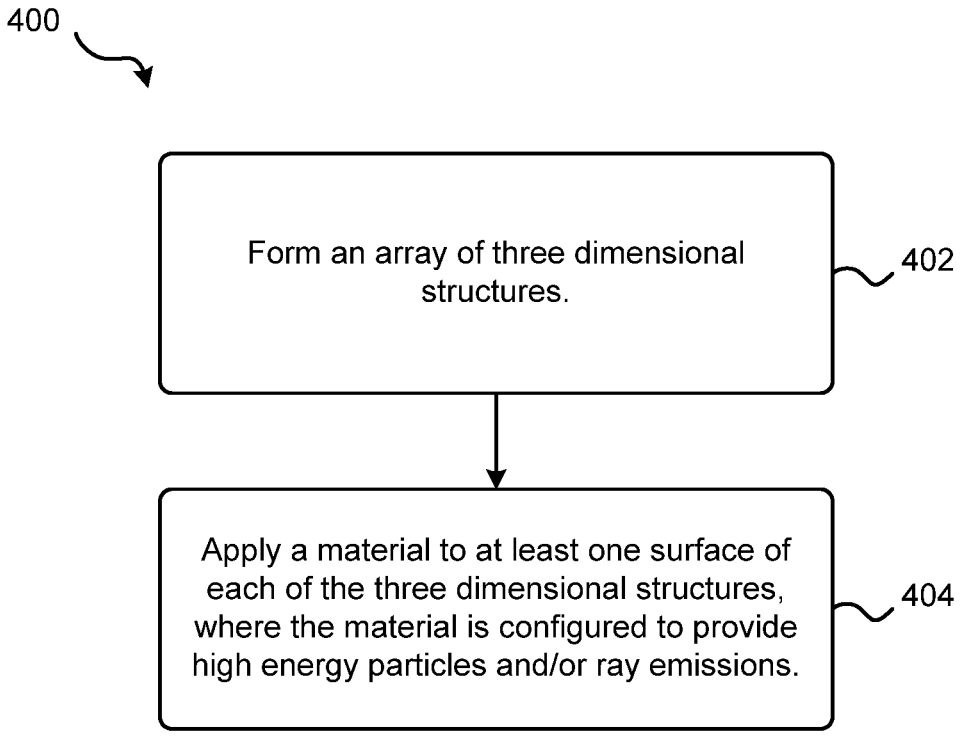
FIG. 4 shows a flowchart of a method, according to one embodiment.

Referring now to FIG. 4, a method 400 for fabricating a structure including three dimensional structures is shown according to one embodiment. As an option, the present method 400 may be implemented in conjunction with features from any other embodiment listed herein, such as those described with reference to the other FIGS. Of course, such method 400 and others presented herein may be used in various applications and/or in permutations, which may or may not be specifically described in the illustrative embodiments listed herein. Moreover, more or less operations than those shown in FIG. 4 may be included in method 400, according to various embodiments. Furthermore, while exemplary processing techniques are presented, other known processing techniques may be used for various steps.

As shown in FIG. 4, the method 400 includes forming an array of three dimensional structures. See operation 402. In some approaches, the three dimensional structures may be formed by wet chemical etching, ion beam etching, plasma etching/processing, etc. or other such suitable process as would be understood by one having skill in the art upon reading the present disclosure.

In other approaches, formation of the three dimensional structures may include providing a host substrate (e.g. glass or other suitable support material) having a mold for 3D definition, and subsequently depositing a semiconductor material on the mold (e.g. via direct writing or depositing of materials by solution, vacuum deposition methods, etc.). These particular approaches may provide an inexpensive route to form very high aspect ratio three dimensional structures.

In preferred approaches, each of the three dimensional structures may include at least one electrically conductive and/or semiconductor material. However, in other approaches where the three dimensional structures may not include an electrically conductive and/or semiconductor material, a supplemental layer of electrically conductive and/or semiconductor material may be deposited directly on the three dimensional structures.

As also shown in FIG. 4, the method 400 also includes applying a first material to at least one surface of each of the three dimensional structures (and/or at least one surface of a supplemental layer of electrically conductive and/or semiconductor material is present), where the first material is configured to provide high energy particles and/or ray emissions. See operation 404. In preferred approaches, the first material may include one or more alpha and/or beta particle emitters. In more preferred approaches, the first material may include one or more radioisotopes selected from a group consisting of: $^{148}$Gd, $^{241}$Am, $^{238}$Pu, $^{63}$Ni, $^{106}$Ru $^{233}$U, and $^{232}$U.

This first material may be applied via electrochemical deposition (electroplating), chemical vapor deposition, sputtering, spin coating, electrophoretic deposition, solution-based approaches (e.g. where a solution including radioactive nanoparticles may be applied to the surface to be coated and subsequently removed via evaporation to leave a coating of radioactive nanoparticles), and other suitable deposition techniques as would be understood by one having skill in the art upon reading the present disclosure. In more approaches, the first material may be dispersed throughout a polymer, and then deposited on the three dimensional structures. In even more approaches, the first material may be coated on a much smaller host material (e.g. polymeric, dielectric, semiconductor or metal spheres, etc.), and then deposited onto at least one surface of the three dimensional structures.

In further approaches, the first material may include one or more metals which may be subject to neutron activation. For example, in one embodiment, the method 400 may include applying a coating of Ni to at least one surface of the three dimensional structures, and then neutron activating the Ni to create the Ni radioisotope, $^{63}$Ni. Such an embodiment may be advantageous as it wilt be easier to complete the metal connection to the three dimensional structures.

In additional embodiments, the method 400 may also include applying one or more additional materials above the first material. In preferred approaches, each of these one or more materials may be configured to provide high energy particles and/or ray emissions. These additional materials may be applied via any of the deposition techniques disclosed herein and/or any other suitable deposition techniques as would be understood by one having skill in the art upon reading the present disclosure. The one or more additional materials may each comprise at least one radioisotope, which may the same or different as a radioisotope present in the first material.

In yet more embodiments, the method 400 may include depositing a functional and/or support material below and/or above the array of three dimensional structures. As an example, this functional material may be metallic to form electrical contacts, which may be connected to a load circuit.

As discussed in greater detail below, the three dimensional structures disclosed herein, which preferably include one or more semiconductor materials, may suffer radiation damage. Accordingly, in some approaches, the method 400 may involve thermal annealing the three dimensional structures to anneal out some, the majority or substantially all of the radiation damage.

As also discussed below, the heat generated by the first material, which serves as the radiation source and is positioned on at least one surface of the three dimensional structures, may mitigate the radiation damage to the three dimensional structures. Accordingly, the method 400 may include selecting the composition and/or other physical parameters (e.g. thickness, density, quantity of alpha and/or beta emitters therein) of the first material (and the one or more additional materials where appropriate) to optimize this self-healing process.

Measuring and/or Mitigating Radiation Damage

In various approaches, the three dimensional structures disclosed herein, which preferably include one or more semiconductor materials, may suffer radiation damage. Radiation damage in semiconductors is typically caused by the collision of an energetic particle or photon with an atom. This may result in the atom being displaced to an interstitial position or electronic charge displacement. The damage site may limit the charge carrier generation and collection.

The radiation damage associated with the three dimensional structures disclosed herein may be studied via current-voltage measurements utilizing, for example, a Parameter Analyzer in some embodiments. For measurements involving three dimensional structures without a radioactive material thereon (e.g. the first material 106 of FIG. 1 including one or more radioisotopes), the radiation source may be a high flux alpha beam.

However, for measurements involving three dimensional structures with a radioactive material deposited thereon, the radiation source may be said radioactive material. For example, in one embodiment, the radioactive material may include microcurie to kilocurie deposits of alpha emitters, and the extent of the radiation damage to the three dimensional structure may be measured by monitoring the electrical output as a function of time. It has been found in some embodiments, that visible damage to the three dimensional structures may occur with a dose of $1\times10^{18}$ alphas/cm$^2$. However in other embodiments, a determination of the impact of radiation damage on that current production may be accomplished with lower alpha deposits.

Moreover, it has also been found in various approaches that while the radioactive material may serve as the radiation source, the heat generated by the radioactive material may nevertheless mitigate the radiation damage to the three dimensional structures. Stated another way, the heat generated by the radioactive material may be used as an in-situ anneal in order to repair damage as it is created, extending the life of the three dimensional structures, as well as any device encapsulating said structures. The required temperature for this self-annealing may depend on several factors: radiation type, dose, energy, and the semiconductor material. For example, temperatures as low as 340K may be effective for annealing radiation damage in a-Si and 448K for annealing damage in SiC. For example, temperatures as low as 340K may be effective for annealing radiation damage in a-Si and 448K for annealing damage in SiC.

Further, it has been found in more approaches that damage and/or degradation of the three dimensional structures including one or more semiconductor and/or electrically conductive materials may occur at elevated temperatures, due to intrinsic properties of said material(s), as well as the external processing conditions. As the carrier concentration of a semiconductor is related to both the material's band gap and the operating temperature, wide band gap materials such as SiC (3.3 eV) and GaN (3.4 eV) may offer potentially superior operation at elevated temperatures compared to Si (1.1 eV).

Another possible degradation route may involve interdiffusion between the metals and the semiconductors, which may occur at elevated temperatures over long periods. Accordingly, the use of refractory metals and compounds in various approaches may prevent this.

Figure 5:
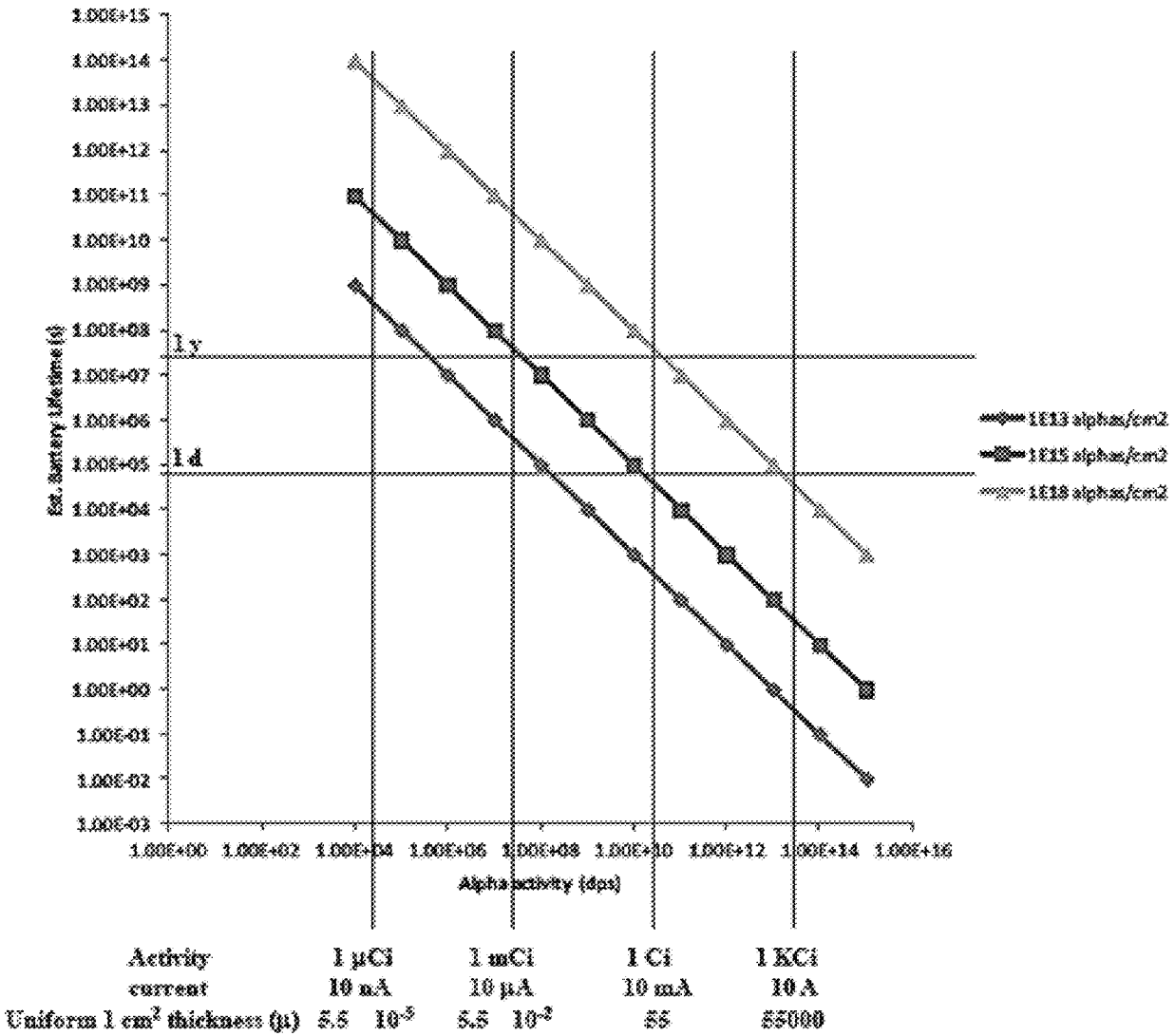
FIG. 5 is a plot of exemplary $^{232}$U lifetimes for various deposited alpha densities as a function of alpha decay rate.

In one particular embodiment, the radiation damage associated with a 1 cm$^3$ $U_3O_8$—Si radioisotope battery was analyzed. FIG. 5 provides some exemplary $^{232}$U lifetimes for various deposited alpha densities as a function of alpha decay rate. Regarding FIG. 5, the thickness of the deposit in microns is for a uniform deposit of the $U_3O_8$ over 1 cm$^3$. Currents are estimated for Si substrates and include current expected from initial 5.3 MeV alpha decay and not the daughter and grand-daughter decays. Deposits with higher activities may benefit from distribution over larger surface areas in more embodiments.

An output power as a function of time for the $U_3O_8$—Si radioisotope battery may reach 50% of its original output power (>100 mW/cm$^3$) after 6 years. Accordingly, to form a 100 W, 1000 cm$^3$ battery, which may be built with a compact 10 cm×10 cm×10 cm array, 45 KCi of $^{232}$U may be used, which is about twice the length of a Rubix cube. It is important to note, that this configuration may generate a significant amount of heat. However, annealing effects due to heat deposited in the three dimensional semiconductor structures may benefit such a battery. Additionally, these self-annealing process may be increased by designing a thermal management system to operate at an optimum temperature. Designing such a thermal management system may include selecting a particular radiation source (e.g. radioisotope), which may operate at a temperature to optimize the self-annealing process.

Uses

Embodiments of the present invention may be used in a wide variety of applications, particularly those applications which utilize power generation devices.

For instance, embodiments of the present invention may be useful as small nuclear batteries. Small nuclear batteries from micro watts to 100 W have a wide variety of commercial and government applications. This technology, depending on the application and power, will make the batteries an off the shelf power supply enabling the tong term use of micro-powered devices and sensors capable of uninterrupted operation from years to as long as exceeding decades.

In addition, embodiments of the present invention may be useful as higher power devices, which may enable deep space probes to operate with a lower size and weight budget than conventional nuclear power supplies.

Accordingly, embodiments of the present invention thus have applications in the defense, international communities, space and other communities.

Any of the structures, methods, etc, described above, taken individually or in combination, in whole or in part, may be included in or used to make one or more systems, devices, etc. In addition, any of the features presented herein may be combined in any combination to create various embodiments, any of which fall within the scope of the present invention.

Moreover, while various embodiments have been described above, it should be understood that they have been presented by way of example only, and not limitation. Thus, the breadth and scope of a preferred embodiment should not be limited by any of the above-described exemplary embodiments, but should be defined only in accordance with the following claims and their equivalents.

What is claimed is:

1. A product, comprising:

an array of three dimensional structures, wherein each of the three dimensional structures comprises a semiconductor material;

a continuous cavity region defined by sidewalls of the three dimensional structures, the cavity region extending along an entire height of the three dimensional structures, the height being defined between top and bottom ends of the respective three dimensional structure;

a first material in direct contact with at least one surface of the semiconductor material of each of the three dimensional structures, wherein the first material fills at least 25% of a volume of the cavity region, wherein the first material includes a first radioisotope configured to provide high energy particle and/or ray emissions; and a second material configured to provide high energy particle and/or ray emissions, wherein the second material includes a second radioisotope which forms a layer that is deposited on at least one portion of the first material;

wherein the second radioisotope is different from the first radioisotope;

wherein the first and second radioisotopes are in direct contact with each other.

2. The product of claim 1, wherein the semiconductor material is selected from a group consisting of: silicon, silicon carbide, gallium arsenide, indium phosphide, icosahedral boride, and gallium nitride.

3. The product of claim 1, wherein each of the three dimensional structures comprises an aspect ratio of less than about 100:1, wherein the first material is in a plane of deposition of the three dimensional structures.

4. The product of claim 1, wherein the first material has a thickness in a range of about 50 to about 500 microns, wherein the second material forms a layer that is deposited directly on at least one portion of the first material.

5. The product of claim 1, wherein the first material comprises a radioisotope selected from a group consisting of: $^{148}$Gd, $^{238}$Pu, $^{244}$Cm, $^{243}$Am, $^{241}$Am, $^{106}$Ru, and $^{232}$U.

6. The product of claim 1, wherein the first material comprises a tritiated metal.

7. The product of claim 1, wherein the second material comprises a radioisotope selected from a group consisting of: $^{148}$Gd, $^{238}$Pu, $^{244}$Cm, $^{243}$Am, $^{241}$Am, $^{106}$Ru, and $^{232}$U.

8. The product of claim 1, further comprising one or more additional materials positioned above at least one portion of the second material, wherein each of the one or more additional materials are configured to provide high energy particle and/or ray emissions.

9. The product of claim 8, wherein each of the one or more additional materials comprises a radioisotope that is independently selected from a group consisting of: $^{148}$Gd, $^{238}$Pu, $^{244}$Cm, $^{243}$Am, $^{241}$Am, $^{63}$Ni, $^{106}$Ru, and $^{232}$U.

10. A method, comprising:

forming an array of three dimensional structures, wherein each of the three dimensional structures comprises a semiconductor material; and depositing a solid first material on at least one surface of the semiconductor material of each of the three dimensional structures, wherein the first material fills at least 25% of a volume of a cavity region between each of the three dimensional structures, wherein a plane of deposition of the semiconductor material of the three dimensional structures extends through the first material, wherein the first material includes two layers, wherein the first layer includes a first radioisotope configured to provide high energy particles and/or ray emissions, wherein the second layer includes a second radioisotope configured to provide high energy particles and/or ray emissions, wherein the second radioisotope is different from the first radioisotope, wherein the first and second radioisotopes are in direct contact with each other.

11. The method of claim 10, wherein the semiconductor material is selected from a group consisting of: single crystal silicon, amorphous silicon, silicon carbide, gallium arsenide, indium phosphide, gallium nitride and an icosahedral boride.

12. The method of claim 10, wherein the first material comprises a radioisotope selected from a group consisting of: $^{148}$Gd, $^{238}$Pu, $^{244}$Cm, $^{243}$Am, $^{241}$Am, $^{106}$Ru, $^{233}$U, $^{232}$U, $^{210}$Po, and a tritiated metal.

13. The method of claim 10, wherein forming the array of three dimensional structures includes at least one process selected from the group consisting of: wet chemical etching, ion beam etching, and plasma etching, wherein the cavity region between each of the three dimensional structures of the array is a continuous cavity region defined by sidewalls of the three dimensional structures, the cavity region extending along an entire height of the three dimensional structures, the height being defined between top and bottom ends of the respective three dimensional structure.

14. The method of claim 10, further comprising applying a second material above the first material, wherein the second material is configured to provide high energy particle and/or ray emissions therefrom to the same sides of the three dimensional structures as the first material, wherein the second material forms a layer that is deposited directly on at least one portion of the first material.

15. The method of claim 14, further comprising applying one or more additional materials above at least one portion of the second material, wherein each of the one or more additional materials is configured to provide high energy particle and/or ray emissions therefrom to the same sides of the three dimensional structures as the second material.

* * * * *